US008261588B2

(12) United States Patent
Šabata

(10) Patent No.: US 8,261,588 B2
(45) Date of Patent: Sep. 11, 2012

(54) CYLINDER LOCK AND KEY COMBINATION

(75) Inventor: Milan Šabata, Kostelec nad Orlici (CZ)

(73) Assignee: Assa Abloy Rychnov, S.R.O., Rychnov Nad Kneznou (CZ)

( * ) Notice: Subject to any disclaimer, the term of this patent is extended or adjusted under 35 U.S.C. 154(b) by 0 days.

(21) Appl. No.: 13/148,847

(22) PCT Filed: Feb. 17, 2010

(86) PCT No.: PCT/CZ2010/000019

§ 371 (c)(1),
(2), (4) Date: Aug. 10, 2011

(87) PCT Pub. No.: WO2010/102591

PCT Pub. Date: Sep. 16, 2010

(65) Prior Publication Data

US 2011/0314880 A1 Dec. 29, 2011

(30) Foreign Application Priority Data

Mar. 9, 2009 (CZ) ..... 2009-147

(51) Int. Cl.
*E05B 29/06* (2006.01)
*E05B 19/06* (2006.01)

(52) U.S. Cl. ..... 70/492; 70/409

(58) Field of Classification Search ..... 70/419, 70/409, 492, 495, 405–407, 421, 358, 377, 70/392, 376, DIG. 37

See application file for complete search history.

(56) References Cited

U.S. PATENT DOCUMENTS

| | | | | |
|---|---|---|---|---|
| 2,023,207 | A * | 12/1935 | Olson | 70/406 |
| 3,263,461 | A * | 8/1966 | Tartaglia | 70/383 |
| 4,320,639 | A * | 3/1982 | Kleefeldt et al. | 70/492 |
| 4,977,767 | A * | 12/1990 | Prunbauer | 70/406 |
| 5,174,141 | A * | 12/1992 | Ohyabu | 70/492 |
| 6,308,543 | B1 * | 10/2001 | Yoshizawa | 70/492 |
| 7,240,525 | B2 * | 7/2007 | Sevillano Gil | 70/340 |
| 7,484,392 | B2 * | 2/2009 | Katagiri | 70/492 |
| 2006/0000251 | A1 * | 1/2006 | Ceron et al. | 70/492 |
| 2007/0006623 | A1 * | 1/2007 | Barrenberg et al. | 70/492 |
| 2008/0196461 | A1 * | 8/2008 | Widen | 70/409 |

* cited by examiner

*Primary Examiner* — Lloyd Gall
(74) *Attorney, Agent, or Firm* — Notaro, Michalos & Zaccaria P.C.

(57) ABSTRACT

Cylinder lock and key with a rotatable plug in a cylindrical housing has radial slots each with two tumblers spring biased in the same direction and provided with side extensions for engaging a supporting spring. The side extensions are oriented opposite each other, and in certain slots the tumblers are spring biased in one direction and in other slots the tumblers are spring biased in another direction. The tumblers have cord projections protruding into a key channel and engaging control paths. The tumblers in series in odd slots are spring biased in one direction and tumblers in even slots are spring biased in the opposite direction, whereby their cord projections protrude in a direction orthogonal to sliding motion of the tumblers so that the cord projections are in each slot, substantially against each other and their lateral control edges adjacent the side projections cooperate with the control paths formed on the adjacent side walls of the control grooves in the key.

10 Claims, 5 Drawing Sheets

CYLINDER LOCK AND KEY COMBINATION

FIELD OF THE INVENTION

The invention relates to a cylinder lock and key combination where a plurality of tumblers are spring biased in one direction and another plurality of tumblers are spring biased in an opposite direction and where the tumblers are actuated by two control grooves, situated on the left wider surface of a key and by two control grooves on the right wider surface of the reversible key.

DESCRIPTION OF PRIOR ART

DE 3036262 A1 discloses a cylinder lock consisting, of a rotatable plug having a key channel and mounted in a cylindrical cavity within housing. The rotatable plug is provided with four radial slots arranged in single file, whereby in each of the slots a couple of tumblers are located. The tumblers have side extensions on their mutually opposite sides and are supported by springs urging the tumblers into a locked position, in which the tumblers extend by their blocking ends beyond the periphery of the plug and protrude into a blocking groove made in a cylindrical cavity of the housing. In the first and third slot, in the direction from the outer front wall of the plug, two couples of half-sized tumblers are located beside each other and in the second and fourth slot two couples of frame tumblers one after the other are located. The tumblers in the two front slots (in the first and the second slot) are spring biased downwardly and the tumblers in the two rear slots (in the third and the fourth slot) are spring biased upwardly. Each frame tumbler is provided with a cord projection protruding or directed respectively into the inner window of the frame tumbler in the direction of its motion and engaging with its front wall a control path of the key. The tumblers are slipped out in the direction orthogonal to the wider key surfaces in which control paths for actuating the cord projections are formed parallel to the key longitudinal axis in one wider surface of the key, the control paths for engagement with the tumblers spring biased in one direction are formed and in the other, wider surface of the key, the control, paths for engagement with the tumblers spring biased in the other direction are formed. The key is reversible and the front portion of the key actuates only the front group of tumblers in the first and the second slot which are spring biased in one direction and the rear portion of the key actuates only the rear group of tumblers in the third and the fourth slot which both are spring biased in the opposite direction.

The cord projections are arranged in different paths situated beside each other what enables the tumblers to be located in one slot adjacent to each other.

In order to impede the picking of the tumblers, the motions of the tumblers in both directions are limited by abutments made on the bottom of blocking grooves in the lock housing, which are engaged by deep cut-outs made in the front walls of the blocking ends of the tumblers.

A disadvantage of this construction is that due to the fact that the cord projection is actuated by one control path in one direction of its motion only (against the force exerted by the spring) a so called micro-freezing effect may occur what means that due to a spring failure or due to impurities or freezing up the tumbler is seized in the slot in a position from which the tumbler may not be moved to a position necessary for unlocking the lock. Another disadvantage of the said construction is that the cord projections of the tumblers extending approximately to the half of the height of the key channel are not disposed against each other so that in the front portion of the key channel there is enough space left for insertion of a picking instrument.

Still another not avoidable disadvantage is a relatively great thickness of the reversible key, and consequently a greater cross section area of the key channel, what enables to screw in a pull-out instrument for pulling out the lock.

SUMMARY OF THE INVENTION

The object of the invention is to substantially eliminate the above-described disadvantages by providing a cylinder lock and key combination the essential features of which are defined so that the tumblers arranged in the odd slots are spring biased in one direction and the tumblers arranged in the even slots are spring biased in the opposite direction, whereby their cord projections protrude into the key channel in the direction orthogonal to the sliding motion of the tumblers so that the cord projections are situated in each slot substantially against each other and their lateral control edges adjacent to the side projections cooperate with the control paths formed on the adjacent side walls of the control grooves formed in each wider surface of the key.

This construction enables the arrangement of two control paths situated above each other on one wider surface and two other control paths situated above each other on the other wider surface of the key. Thus, the key is narrower in width than if the control paths were arranged side by side. This arrangement enables a narrower key channel to be formed, which restricts the space available for insertion of an instruments used by unauthorized persons to unlock the lock or to pull out the lock. Since the cord projections are actuated by both opposite walls of the key control groove, upon insertion of the key into the key channel the tumblers are set into the correct positions even when the tumbler freezes up i.e. if it is temporary immovable due to a spring failure or impurities or actual freezing up. Further, this construction enables blocking of the plug inside the lock housing so that the tumblers in the odd slots are blocking the plug towards one side of the housing and the tumblers in the even slots are blocking the plug towards the opposite side of the housing. Accordingly, the blocking forces are uniformly distributed along the whole length of the plug and housing.

It is advantageous if the cord projections of the tumblers urged by a spring downwardly and having the side extensions on the left side are actuated by the first upper groove on the left wider surface of the key while the cord projections of the tumblers urged by the spring downwardly and having the side extension on the right side are actuated by the first upper groove on the right wider surface of the key and the cord projections of the tumblers urged by the spring upwardly and having the side projections on the left side are actuated by the second lower groove on the left wider surface of the key, while the cord projections of the tumblers having the side projections on the right side are actuated by the second lower groove on the right wider surface of the key.

This construction makes it possible to place into one slot two tumblers provided with greater mutual offsets—steps—which results in an increase in the number of combinations available and further in the positioning of the cord projections substantially against each other, this configuration reduces the space in the key channel available for unauthorized manipulation within the key channel and considerably impedes the insertion of a picking instrument or another instrument for unauthorized unlocking the lock.

It is advantageous if in each odd slot, always close to the front wall of the plug, a tumbler of one system with side extension in one direction is placed and in each even slot always close to the front wall of the plug, a tumbler of second system with side extension in another direction is placed.

This construction provides for the same pitches between the cord projections of one system of tumblers to each other and for the same pitches between the cord projections of the second system tumblers to each other in the direction of the plug axis, whereby the pitches between the cord projections of one system of tumblers are moved over with respect to the pitches between the cord projections of the second system of tumblers by a thickness of one tumbler. This enables the coding of two tumbler systems, each of which is biased in another direction alternately in one control path of the reversible key.

In a still another advantageous embodiment, the tumblers having the cord projections actuated by the upper groove on the left wider surface of the key and by the lower groove on the right wider surface of the key are A-type tumblers, while the tumblers having the cord projections actuated by the upper groove on the right wider surface of the key and by the lower groove on the left wider surface of the key are B-type tumblers. This solution enables for the offset of the height of the left wider surface of the key against the height of the opposite right wider surface of the key, which enables the constitution of guiding ribs on the narrow key surfaces.

Further, it is advantageous if the slide motion of the tumblers is, at least in the direction of the force exerted by the spring, restricted by a first abutment for engagement with a selected portion of the tumbler.

In this way picking of the tumblers is substantially aggravated and their control projections may be positioned in at least two height levels, when the key is out of the key channel.

In another advantageous embodiment, the first abutment situated in the direction of the force exerted by the spring is formed as a bar-shaped member fixed in a groove provided in the peripheral surface of the plug parallel to its longitudinal axis and crossing the cavity for the side extension whereby the upper edge of the side extension of the tumbler engages the bar-shaped member.

On one hand, this embodiment impedes the picking of the tumblers by preventing at least certain tumblers from engaging with their blocking ends the bottom of the blocking groove and sets up at least two cord projections of the tumblers of different size at the same height level and on the other hand, it holds the spring biased tumblers altogether in the plug, that makes the process of inserting the plug into the cylindrical cavity of the lock housing easier.

In another advantageous embodiment, the cord projections are positioned on each side of the key channel at least at two height levels, when the tumblers are in the position extending out of the plug.

This design enables the reduction of the depth of the blocking groove in the housing cylindrical cavity and thus the reduction of the outer transverse dimension of the housing unlike the configuration with the cord projections at one height level and moreover reduces the space in the key channel available for unauthorized manipulation within the key channel and considerably impedes the insertion of a picking instrument or another instrument for unauthorized unlocking of the lock.

According to another advantageous embodiment, the plug includes at least one type of tumblers, A-type tumblers or B-type tumblers, whereby the tumblers are created in four different step sizes and two different distances between the control edges of the cord projections and the abutment edges of the side projections of the tumblers, whereby the distance between the abutment edges of the numbers and the control edges of the cord projections with the steps 1 and 2 (tumbler size $Z_1$ and $Z_2$) has a value X, W and the distance between the cord projection with steps 3 and 4 (tumbler size $Z_3$ and Z4) has a value Y, V, whereby the value of X is bigger than Y and the value of W is bigger than V. This construction enables the arrangement of the cord projections up to eight height levels in the key channel namely at four height levels on the left side and four height levels on the right side that results in a reduction of the space available for unauthorized manipulations in the key channel.

It is also advantageous if the slide motion of the tumblers opposite the direction of the force exerted by the spring is restricted by a second abutment for engagement with a selected portion of the tumbler.

This construction considerably reduces the possibility of picking of the tumblers in the direction opposite the force exerted by the spring.

According to another advantageous embodiment, the second abutment is created by a shoulder provided on the side wall or on the bottom of the cavity for receiving the side extension in which cavity the spring is mounted, whereby the shoulder engages with a lower edge of the tip of the side extension or with a lower edge of the side extension at its inner end or its portion approaching the body of the tumbler respectively.

This construction is favorable with respect to the manufacturing technology and does not require any use of other components.

BRIEF DESCRIPTION OF THE DRAWINGS

The accompanying drawings show an example of embodiments of the invention where.

DETAILED DESCRIPTION OF EMBODIMENT OF THE INVENTION

Figure 1:
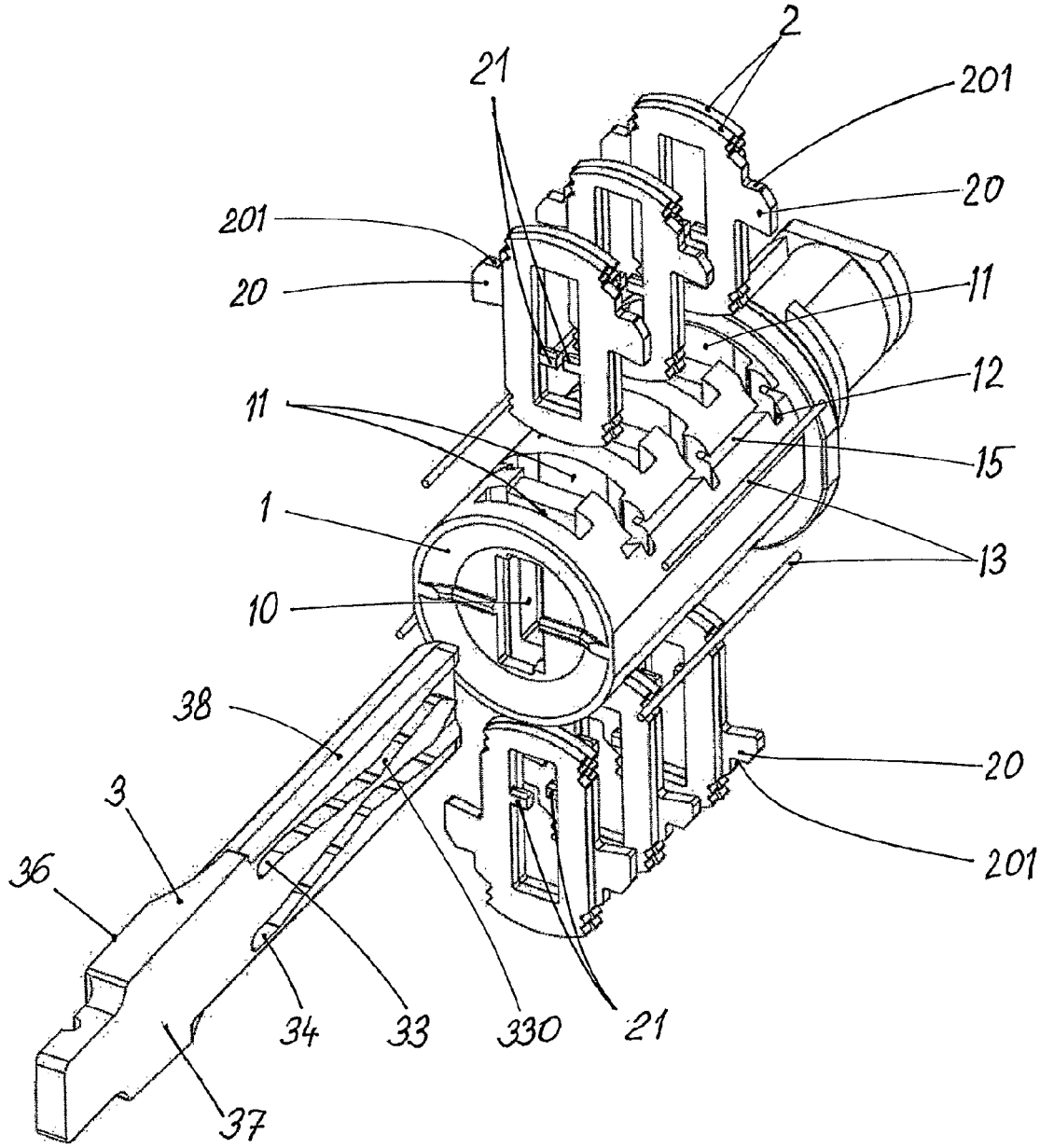
FIG. 1—is an exploded perspective view of the lock with a key in a distributed state.
Figure 2A:
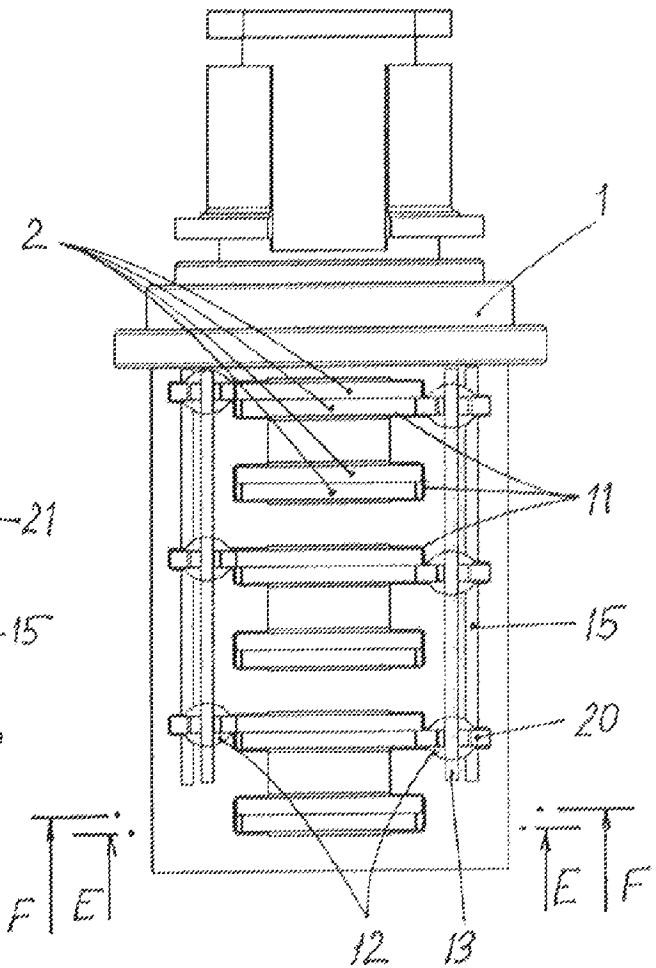
FIG. 2*a*—is a plan: view of aping.
Figure 2B:
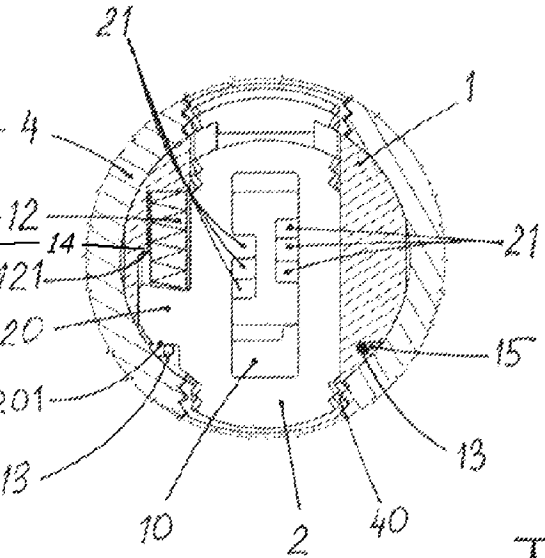
FIG. 2*b*—is a sectional view along the line E-E of FIG. 2*a;*
Figure 2C:
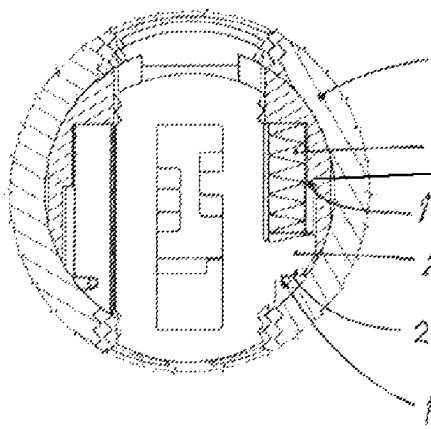
FIG. 2*c*—is a sectional view along the line F-F of FIG. 2*a;*
Figure 3A:
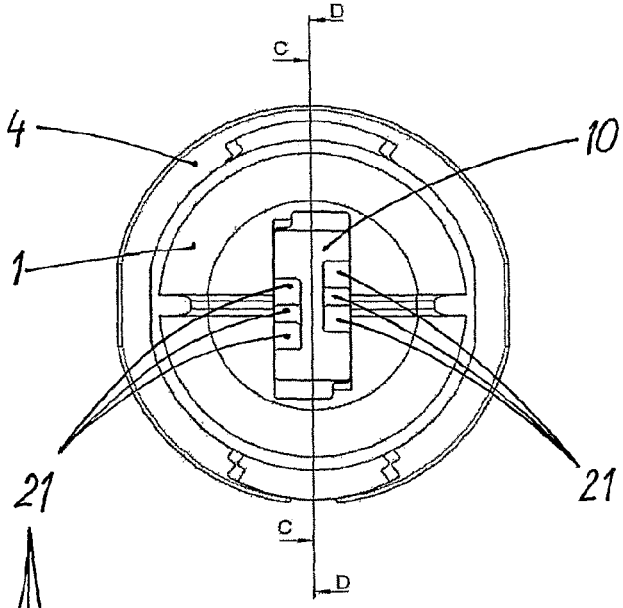
FIG. 3*a*—is a view of cord projections in a key channel when the key is removed.

As may be seen from the accompanying drawings, a cylinder lock includes a plug 1 with a key channel 10, rotatably mounted in a cylindrical cavity of a housing 4. In the plug 1, there are in series provided radial slots 11 in which frame tumblers 2 are slidably mounted so that in the odd slots 11 two downwardly spring biased tumblers 2 are mounted and in the even slots 11 also two tumblers 2 are mounted but spring biased upwardly (see for example FIG. 1, FIG. 2*a*, FIG. 3*b*). The spring biasing is effected by coiled springs positioned between an inner edge of a side extension 20 and a bottom of a cavity 12 receiving the side extension 20. The side extension 20 of the first tumbler 2 in the slot 11 is directed to one side—to the left—and the side extension 20 of the second tumbler 2 in the same slot 11 is directed to the other side—to the right (see for example FIG. 1 and FIGS. 2*a* to 2*.c*). Each frame tumbler 2 is provided with a cord projection 21 extending out of the longer side of its rectangular-shaped window 23, adjacent to the side extension 20 which cord projection 21 protrudes into the key channel 10 (FIG. 2B, FIG. 3*a*). In other words, the cord projection 21 is situated on such tumbler 2 lateral wall 25, on which the side extension 20 is provided. The distance (pitch) a, b, between a control edge 210 of the cord projection 21 and the shorter wall 24 of the rectangular window 23 of the tumbler 2 indicates the type of the tumbler (see FIG. 5*a* to FIG. 6*d*). The tumblers 2 having a pitch "a" will be hereinafter referred to as A-type tumblers (see FIGS. 5*a* to 5*d*) and the tumblers having the pitch "b" will be hereinafter referred to as B-type tumblers (see FIGS. 6*a* to 6*d*). The distances 1 to Z4 between the control edges 210 of the cord projection 21 of the tumbler 2 in the direction "F", in which the coiled spring force is exerted and a circle circumscribing the tumbler 2 determine the step sizes Z1, Z2, Z3, Z4 of the tumblers 2.

Figure 4A:
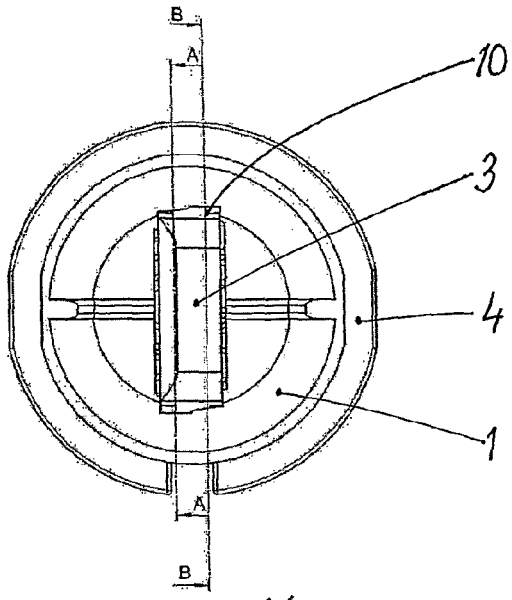
FIG. 4*a*—is a view of the plug with an inserted key in FIG. 2*a* in "S" direction.
Figure 4B:
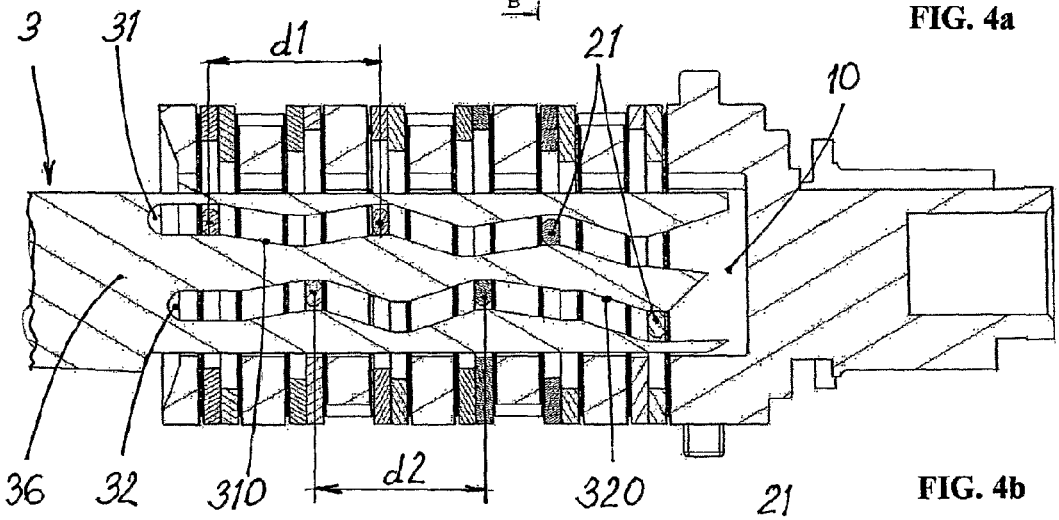
FIG. 4*b*—is a sectional view along the line A-A of the plug in FIG. 4*a;*
Figure 4C:
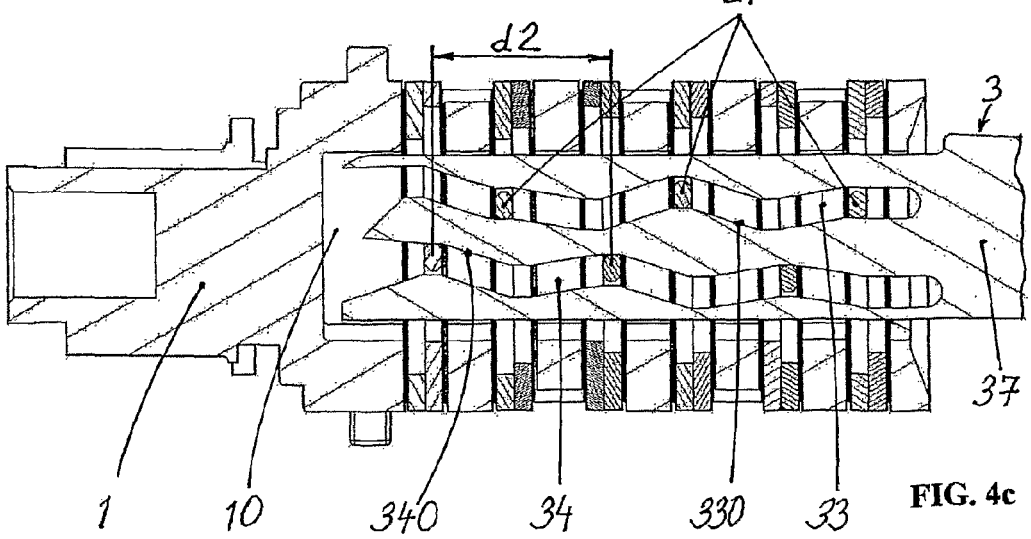
FIG. 4*c*—is a sectional view along the line B-B of the plug in FIG. 4*a;*
Figure 5A:
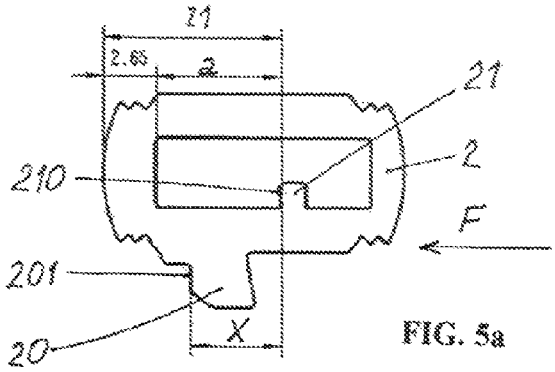
FIGS. 5*a* to 5*d*—show tumblers of A-type in four sizes.
Figure 5B:
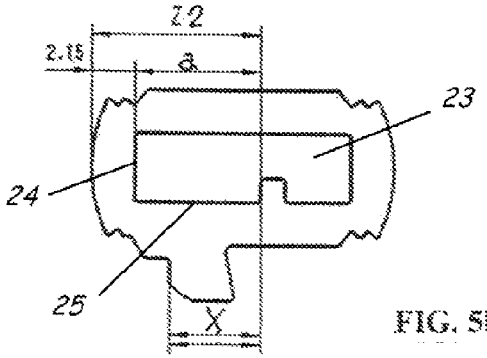
Figure 5C:
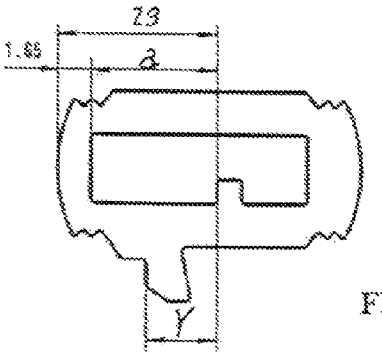
Figure 5D:
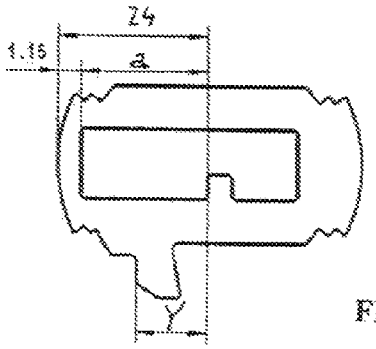

When a key is inserted in full, the cord projections 21 of the tumblers 2 are urged by the key cord grooves 31, 32, 33, 34 into the positions, where the tumblers 2 do not extend above the periphery of the plug 1, making it possible to rotate the plug 2 in the housing 4 (FIG. 4*b*, 4*c*). In this position the cord projections 21 of tumblers 2 urged by the coil spring downwardly and carrying the side extensions 20 on the left side are actuated by the first upper cord groove 31 on the left wider surface 36 of the key 3 (see FIG. 4*b*) and the cord projections 21 of the tumblers 2 urged by the coil spring downwardly and carrying the side extension 20 on the right side are actuated by the first upper cord groove 33 on the right wider surface 37 of the key 3 (see FIG. 4*c*). The cord projections 21 of the tumblers 2 urged by the coil spring upwardly and carrying the side projections 20 on the left side are actuated by the second lower groove 32 on the left wider surface 36 of the key 3, while the cord projections 21 of the tumblers 2 having the side extension 20 on the right side and urged by the coil spring upwardly are actuated by the second lower groove 34 on the right wider surface 37 of the key 3. In other words, the tumblers 2 urged by the spring downwardly are actuated by the upper groves 31, 33 and the tumblers 2 urged by the spring upwardly are actuated by the lower grooves 32, 34 of the key 3, more specifically by their control paths 310, 320 and 330, 340, formed in the adjacent side walls of the cord grooves 31, 32, and the cord grooves 33, 34.

As best shown in FIG. 4*b*, 4*c*, the control path 310 of the left upper cord groove 31 is identical with the control path 340 of the right lower cord groove, if the key is reversible. On each of the control paths 310, 320, 330, 340, codes are formed in series alternately with respect to two systems of tumblers 2, namely for the system of tumblers spring biased: downwardly below the odd slots 11 and for the system of tumblers 2 spring biased upwardly below the even slots 11. When the key 3 is inserted to its first position, on each control path 310, 320, 330, 340 only the coding of one system is in operation and when the key 3 is inserted into its second position, i.e. turned around its longitudinal axes over 180°, only the coding of the second system is in operation.

By reason that in each odd slot 11, always close to the front wall of the plug 1, a tumbler 2 of one system with side extension 20 in one direction is placed and in each even slot 11 always close to the front wall of the plug 1, a tumbler 2 of second system with side extension 20 in another direction is placed, the distances d1, d2 between the control extensions 21 of the two systems of tumblers 2 in the direction of axis of the core 1 are identical. The same holds for the distances of codes on the control paths 310, 320, 330 and 340.

If the height of the left wider surface 36 is offset with respect to the height of the right wider surface 37 of the key 3, mostly for the purpose of forming guide ribs 38 on the narrow key sides (see FIG. 1), it is advantageous, when the first tumbler 2, in each slot 11 be always of one type for instance A-type tumbler and the second tumbler 2 in each slot be always of another type for instance the B-type tumbler, notwithstanding they are spring biased in one or another direction. In this case, the offset height and so the height of the rib 38 corresponds to the difference "b-a" of the distances of the control edges 210 of the cord projections 21 between the type A and B. When the wider surfaces 36, 37 of the key are not mutually set out, the tumblers of one type are used only.

After removing the key 3, the spring biased tumblers 2 slip out from the plug 1 into blocking grooves 40 made in the housing 4 and consequently, the plug 1 may not be turned in the housing 4 and the lock is locked (see FIG. 2*b*, 2*c*, 3*b*, 3*c*). The extended tumblers 2 engage by the upper edges 201 of the side extensions 20 the first abutments 13 consisting of four bars fixed in grooves 15 provided on the peripheral surface of the plug 1, parallel to its longitudinal axis. Said first abutments 13 which, impede the picking of the tumblers 2, when they are moving in the direction of the force exerted by the coil spring, are further used for positioning the cord projections 21 in the key channel 10 at several height levels. At these levels the cord projections 21 of the tumblers 2 sizes Z1, Z2, Z3, Z4, which are distinguished by size from each other by one step (as a rule 0.5 mm) are arranged in alignment at the same height level.

Figure 3B:
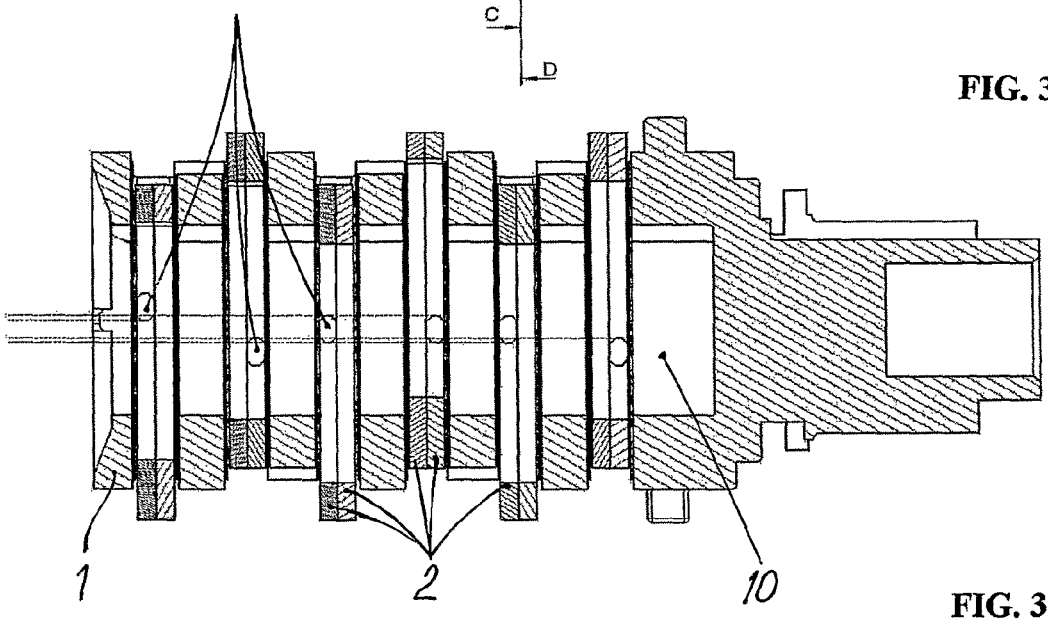
FIG. 3*b*—is a view of cord projections of FIG. 3*a* in "D" direction.
Figure 3C:
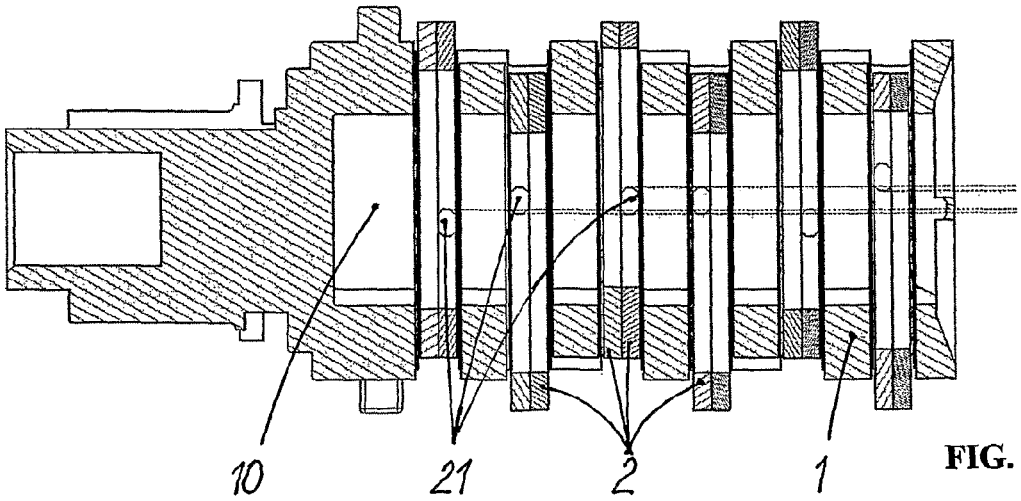
FIG. 3*c*—is a view of cord projections of FIG. 3*a* in "C" direction.

The height levels result from the distances X, Y, W, V of the control edges 210 from the abutment edges 201 (see FIG. 5*a* to FIG. 6*d*), which engage with the first abutments 13. FIGS. 2*b*, 2*c* and 3*a* show the cord projections 21 protruding into both the left and the right side of the key channel 10 at three height levels on each side. FIG. 3*c* shows the configuration of the cord projections 21 on the right side of the key channel 10 at three height levels and FIG. 3*b* shows the configuration of the cord projections 21 on the left side of the key channel 10 at three height levels. In the subject embodiment, up to four height levels may be obtained on each side, i.e. eight height levels altogether.

Figure 6A:
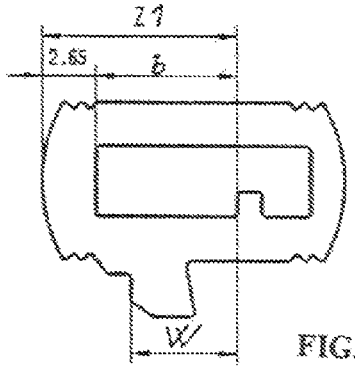
FIG. 6*a* to 6*d*—show tumblers of B-type in four sizes.
Figure 6B:
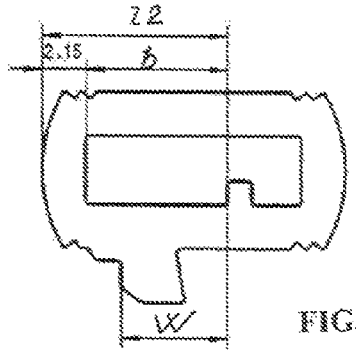
Figure 6C:
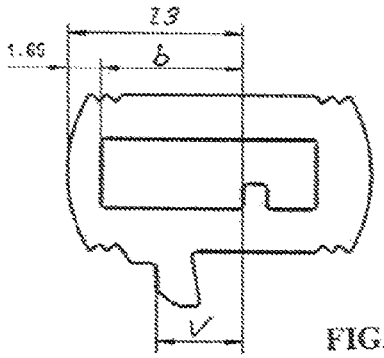
Figure 6D:
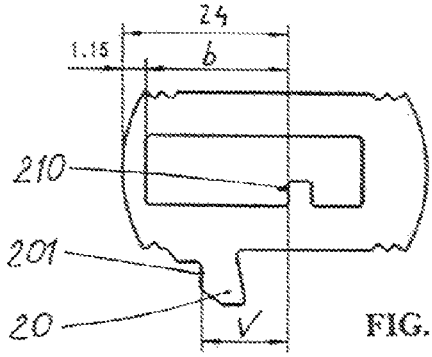

In order to impair reading of tumblers 2 by their moving in the directions opposite the force of the spring, it is advantageous to provide a second abutment 14 for engagement with a selected portion of the tumbler 2. The most advantageous solution is, when the second abutment 14 is formed as a shoulder 121 on the side wall or on the bottom of the cavity 12 for receiving the side extension 20, and in which the coil spring is mounted. The shoulder is engaged by the lower edge of the side extension 20 at its outer end or by an offset provided on the lower edge in the area adjacent to the body of the tumbler 2. It is to be understood that the first abutment 13 and the second abutment 14 may be constituted by way of a cage or ribs arranged in the blocking grooves 40 of the cage 4 as shown in FIGS. 5 to 6*d* alternatively, by other conventional methods.

LIST OF REFERENCES

1 plug
10 key channel
11 slot
12 cavity (for side extension)
121 shoulder
13 first abutment

14 second abutment (shoulder 121)
15 groove
2 tumbler
20 side extension
201 abutment edge
21 cord projection
210 control edge
3 key
31 upper groove (on the left surface)
310 control paths
32 lower groove (on the left surface)
320 control paths
33 upper groove (on the right surface)
330 control paths
34 lower groove (on the right surface)
340 control paths
36 left wider surface
37 right wider surfaces
38 guide rib
4 housing
40 blocking groove
X, Y, W, V distances between the control edges 210 and abutment edges 201
Z1 to Z4 sizes of the tumblers 1 to 4
d1 distances of codes (for tumblers of the first system)
d2 distances of codes (for tumblers of the second system)

The invention claimed is:

1. Cylinder lock and key combination with a plug (1) rotatably mounted in a cavity of a cylindrical housing (4), the plug being provided with radial slots (11) arranged in series, each radial slot (11) including two tumblers (2) spring biased in the same direction and provided with side extensions (20) for engagement with a supporting spring, the side extensions (20) being oriented opposite to each other, whereby in certain slots (11) the tumblers (2) are spring biased in one direction and in other slots (11) the tumblers (2) are spring biased in another direction, whereby the tumblers are provided with cord projections (21) protruding into a key channel (10) and engaging corresponding control paths (310, 320, 330, 340) by their control edges (210), the control paths (310, 320, 330, 340) being formed along a longitudinal axis of a key (3) on its wider surfaces, characterized in that the tumblers (2) arranged in series in the odd slots (11) are spring biased in one direction and the tumblers (2) arranged in series in the even slots (11) are spring biased in the opposite direction, whereby their cord projections (21) protrude into the key channel (10) in the direction orthogonal to the sliding motion of the tumblers (2) so that the cord projections (21) are situated in each slot (11) projecting substantially towards and parallel to each other and their control edges (210) cooperate with the control paths (310, 320, 330, 340) formed on the adjacent side walls of control grooves (31,32, 33, 34;) formed in each wider surface of the key (3).

2. Cylinder lock and key combination according to claim 1 characterized in that the cord projections (21) of the tumblers (2) urged by a spring downwardly and having the side extensions (20) on a left side are actuated by a first upper groove (31) on a left wider surface of the key (3) while the cord projections (21) of the tumblers (2) urged by the spring downwardly and having the side extension on a right side are actuated by a first upper groove (33) on a right wider surface of the key (3) and the cord projections (21) of the tumblers (2) urged by the spring upwardly and having the side extensions (20) on the left side are actuated by a second lower groove (32) on the left wider surface of the key (3), while the cord projections (21) of the tumblers (2) having the side extensions (20) on a right side are actuated by a second lower groove (34) on the right wider surface of the key (3).

3. Cylinder lock and key combination according to claim 1 characterized in that in an odd slot (11) closest to a front wall of the plug (1), a tumbler (2) of a first system with side extension (20) in one direction is placed and in an even slot (11) closest to the front wall of the plug (1), a tumbler (2) of a second system with side extension (20) in another direction is placed.

4. Cylinder lock and key combination according to claim 1 characterized in that the tumblers (2) having the cord projections (21) actuated by an upper groove (31) on a left wider surface of the key (3), and by a lower groove (34) on a right wider surface of the key (3) are A-type tumblers, while the tumblers having the cord projections (21) actuated by an upper groove (33) on the right wider surface of the key (3) and by a lower groove (32) on the left wider surface of the key (3) are B-type tumblers; and wherein the A-type tumblers and the B-type tumblers each have a different characteristic distance (a, b) between the control edge (210) of the cord projection (21) and a shorter wall (24) of a rectangular window (23) of the tumbler (2) that the control edge (210) faces.

5. Cylinder lock and key combination according to claim 1 characterized in that the slide motion of the tumblers (2) is, at least in the direction of the force exerted by the spring, restricted by a first abutment (13) for engagement with a portion of the tumbler (2).

6. Cylinder lock and key combination according to claim 5 characterized in that the first abutment (13) situated in the direction of the force exerted by the spring is formed as a bar-shaped member fixed in a groove (15) provided in the peripheral surface of the plug (1) parallel to its longitudinal axis and crossing a cavity (12) for the side extension (20), whereby an upper edge (201) of the side extension (20) of the tumbler (2) engages the bar-shaped member.

7. Cylinder lock and key combination according to claim 5 characterized in that the cord projections (21) are positioned on each side of the key channel (10) at least at two height levels, when the tumblers (2) are in the position extending out of the plug (1).

8. Cylinder lock and key combination according to claim 5 characterized in that the plug (1) includes at least one type of tumblers (2), A-type tumblers or B-type tumblers, whereby the tumblers (2) are created in four different step sizes (Z1, Z2, Z3, Z4) and four possible distances (X, Y, W, V), including at least two different distances, between the control edges (210) of the cord projections (21) and abutment edges (201) of the side extensions (20) of the tumblers (2), whereby the distance between the abutment edges (201) and the control edges (210) with the steps sizes Z1 and Z2 has a value (X, W) and the distance between the abutment edges (201) and control edges (210) with steps sizes Z3 and Z4 has a value (Y, V), whereby the value of X is bigger than Y and the value of W is bigger than V; and wherein the A-type tumblers and the B-type tumblers each have a different characteristic distance (a, b) between the control edge (210) of the cord projection (21) and a shorter wall (24) of a rectangular window (23) of the tumbler (2) that the control edge (210) faces.

9. Cylinder lock and key combination according to claim 1 characterized in that the slide motion of the tumblers (2) opposite the direction of the force exerted by the spring is restricted by a second abutment (14) for engagement with a selected portion of the tumbler (2).

10. Cylinder lock and key combination according to claim 9 characterized in that the second abutment (14) includes a shoulder (121) located on a side wall or a bottom of a cavity (12) for receiving the side extension (20) and in which the spring is mounted, whereby the shoulder (121) is engaged with the side extension (20).

* * * * *